US006879321B2

(12) United States Patent
Santou

(10) Patent No.: US 6,879,321 B2
(45) Date of Patent: Apr. 12, 2005

(54) DISPLAY POSITION CONTROL APPARATUS

(75) Inventor: Osamu Santou, Fukuroi (JP)

(73) Assignees: Pioneer Corporation, Tokyo-To (JP); Shizuoka Pioneer Corporation, Shizuoka-Ken (JP)

( * ) Notice: Subject to any disclaimer, the term of this patent is extended or adjusted under 35 U.S.C. 154(b) by 222 days.

(21) Appl. No.: 10/179,266

(22) Filed: Jun. 26, 2002

(65) Prior Publication Data

US 2003/0006981 A1 Jan. 9, 2003

(30) Foreign Application Priority Data

Jul. 3, 2001 (JP) ..... 2001-202696

(51) Int. Cl.[7] ..... G09G 5/00

(52) U.S. Cl. ..... 345/213; 345/214; 348/511; 348/513

(58) Field of Search ..... 345/90, 94, 98–100, 345/698, 208, 213–214, 87, 156, 157, 160, 161, 162, 163, 167, 168, 204, 205, 211, 212; 348/511, 513, 530, 536, 540, 545, 801, 802

(56) References Cited

U.S. PATENT DOCUMENTS 5,406,308 A * 4/1995 Shiki ..... 345/99
5,610,667 A * 3/1997 Hush ..... 348/796
6,137,536 A * 10/2000 Yamaguchi ..... 348/521
6,229,573 B1 * 5/2001 Sato et al. ..... 348/516
6,310,618 B1 * 10/2001 Zhang et al. ..... 345/213

* cited by examiner

*Primary Examiner*—Bipin Shalwala
*Assistant Examiner*—Mansour M. Said
(74) *Attorney, Agent, or Firm*—Sughrue Mion, PLLC

(57) ABSTRACT

The present invention intends to provide a display position control apparatus which can prevent a position control signal to control a display position of an image from being unstable and can display the image with high image quality. A delay signal having a phase difference in a match state with reference to a vertical sync signal is generated. Whether a phase relation between the vertical sync signal and a horizontal sync signal is in a mismatch state is detected. When it is detected that the phase relation is in the mismatch state, a display position control signal is generated on the basis of the vertical sync signal and the delay signal. When it is not detected that the phase relation is in the mismatch state, the display position control signal is generated on the basis of the vertical sync signal and the horizontal sync signal.

8 Claims, 9 Drawing Sheets

DISPLAY POSITION CONTROL APPARATUS

BACKGROUND OF THE INVENTION (i) Field of the Invention

The present invention relates to a technical field of a display position control apparatus and, more particularly, to a technical field of a display position control apparatus for controlling a display position of an image in a matrix type display apparatus.

(ii) Description of the Related Art

When an image is displayed using a matrix type display apparatus such as a liquid crystal display or a PDP (Plasma Display Panel), generally, the display position of the image in the display apparatus is controlled on the basis of a vertical sync signal and a horizontal sync signal included in an image signal that corresponds to the image to be displayed and is inputted from the outside.

In this instance, as a relation between the vertical sync signal, the horizontal sync signal, and the image signal as the image itself, various forms are currently used. There is a display position control method in which the vertical sync signal and the horizontal sync signal are supplied independent of each other and the signals are also inputted from the outside independent of the image signal, namely, the method using separate type sync signals as one of the above various forms.

In this case, when the display position of the image is controlled using the separate type sync signals, in order to perform the position control in the horizontal direction, the display position in the horizontal direction is first determined on the basis of timing of the horizontal sync signal as a reference. In order to perform the position control in the vertical direction, the vertical sync signal is latched using the horizontal sync signal to count the number of horizontal sync signals on the basis of timing of the vertical sync signal. Consequently, the display position in the vertical direction is determined.

In this case, when the number of horizontal sync signals counted at an interval between the adjacent vertical sync signals on a time axis (namely, the number of horizontal scan lines counted at an interval between the adjacent vertical sync signals) is constant while one image is displayed, the necessary image can be displayed with high image quality without being fluctuated in the vertical direction (namely, being overlapped so as to be blurred in the vertical direction). In this instance, in order to maintain the predetermined number of horizontal sync signals counted at an interval between the adjacent vertical sync signals while one image is displayed as mentioned above, it is necessary to prevent the vertical sync signal and the horizontal sync signal from being inputted overlappingly on the time axis or being inputted at timings extremely close to each other, namely, prevent phase distortion between the vertical sync signal and the horizontal sync signal (hereinbelow, the state in which the phase distortion is caused is referred to as a phase mismatch state).

However, the above conventional display position control method using the separate type sync signals has the following disadvantages. That is, a device for generating and outputting the vertical sync signal and the horizontal sync signal has a variation in delay time, a processing of determining the relation between the phase of the vertical sync signal and that of the horizontal sync signal is not performed in the device, and the above-mentioned phase mismatch state is actually caused by various noises mixed in a step of generating and transmitting the vertical sync signal and the horizontal sync signal. Consequently, the image is displayed overlappingly, particularly, in the vertical direction in the display apparatus.

SUMMARY OF THE INVENTION

The present invention is made in consideration of the above disadvantages. It is an object of the present invention to provide a display position control apparatus which prevents the instability of a position control signal to control a display position of an image so that the image can be displayed with high image quality.

The above object of the present invention can be achieved by a display position control apparatus. The display position control apparatus which uses a first sync signal to control a display position of an image in one direction of matrix type display device such as a PDP and a second sync signal, different from the first sync signal, to control the display position of the image in another direction of the display device to generate a position control signal to control the display position of the image in the display device, provided with: a sync signal generating device which generates a third sync signal having a phase difference held in a preset match state with respect to the phase of the first sync signal; a detecting device which detects whether a phase relation between the phase of the first sync signal and the phase of the second sync signal is held in a preset mismatch state; and a control signal generating device which generates the position control signal on the basis of the first sync signal and the third sync signal when it is detected that the phase relation is in the mismatch state, and generates the position control signal on the basis of the first sync signal and the second sync signal when it is not detected that the phase relation is in the mismatch state.

According to the display position control apparatus, the third sync signal having a phase difference held in the match state with respect to the first sync signal is generated, when it is detected that the phase relation between the phase of the first sync signal and the phase of the second sync signal is in the mismatch state, the position control signal is generated on the basis of the first and third sync signals, and when it is not detected that the phase relation is in the mismatch state, the position control signal is generated on the basis of the first and second sync signals. Consequently, the position control signal can be generated by always using any sync signal, which is in the match state with respect to the first sync signal. It is possible to prevent the instability of switching timing of the position control signal caused by the mismatch state of the phase relation between the phase of the first sync signal and that of the second sync signal.

In one aspect of the display position control apparatus, the detecting device comprises: mismatch detection signal generating device such as a phase detection pulse generating unit which generates a mismatch detection signal having a preset pulse width on the basis of the second sync signal; and determining device such as a phase mismatch detection pulse generating unit which determines that the phase relation is in the mismatch state when timing of one pulse of the first sync signal is included within a range of the pulse width of the generated mismatch detection signal, and determines that the phase relation is not in the mismatch state when the timing of one pulse of the first sync signal is not included within the range.

According to this aspect, for the relation with the mismatch detection signal generated on the basis of the second sync signal, when the timing of one pulse of the first sync signal is included within the range of the pulse width of the mismatch detection signal, it is determined that the phase relation is in the mismatch state, and when the timing of one pulse of the first sync signal is not included within the range, it is determined that the phase relation is not in the mismatch state. Consequently, the mismatch state of the phase relation can be surely detected with a simple constitution.

In another aspect of the display position control apparatus, the mismatch detection signal generating device generates the mismatch detection signal having the pulse width in which timing of one pulse of the second sync signal is set to the center timing of the mismatch detection signal.

According to this aspect, since the mismatch detection signal is generated using the timing of one pulse of the second sync signal as the center timing, the mismatch state of the phase relation can be detected by setting a period corresponding to pulses before and after the pulse of the second sync signal as an object.

In further aspect of the display position control apparatus further comprises: second detecting device such as a phase match detection pulse generating unit which detects whether the phase relation between the phase of the first sync signal and the phase of the second sync signal is in the match state; and second control signal generating device which generates the position control signal on the basis of the first sync signal and the second sync signal when it is detected that the phase relation is in the match state.

According to this aspect, the second detecting device which detects whether the phase relation is in the match state is disposed separately from the detecting device. When the second detecting device detects that the phase relation is in the match state, the position control signal is generated on the basis of the first and second sync signals. Consequently, even when the detection itself of the match state is unstable, the position control signal can be generated in such a state that the phase relation is held more surely in the match state.

In further aspect of the display position control apparatus, the second detecting device comprises: match detection signal generating devise such as a phase detection pulse generating unit which generates a match detection signal having a preset pulse width on the basis of the third sync signal; and second determining device such as a phase match detection pulse generating unit which determines that the phase relation is in the match state when the timing of one pulse of the first sync signal is included within a range of the pulse width of the generated match detection signal.

According to this aspect, for the relation with the match detection signal generated on the basis of the third sync signal, when the timing of one pulse of the first sync signal is included within the range of the pulse width of the match detection signal, it is determined that the phase relation is in the match state. Consequently, the match state of the phase relation can be detected more surely with a simple constitution.

In further aspect of the display position control apparatus, the match detection signal generating device generates the match detection signal having the pulse width in which timing of one pulse of the third sync signal is set to the center timing.

According to this aspect, since the match detection signal is generated using the timing of the pulse of the third sync signal as the center timing, the match state of the phase relation can be detected by setting a period corresponding to pulses before and after the pulse of the third sync signal as an object.

In further aspect of the display position control apparatus, the direction denotes the vertical direction in the display device, the first sync signal is a vertical sync signal, the other direction denotes the horizontal direction, and the second sync signal is a horizontal sync signal.

According to this aspect, due to the stabilization of the position control signal, a fluctuation of the image in the vertical direction in the display device is suppressed, so that the image to be displayed can be displayed with high image quality.

DETAILED DESCRIPTION OF THE PREFERRED EMBODIMENTS

Preferred embodiments of the present invention will now be described with reference to the drawings.

In the embodiments explained hereinbelow, the present invention is applied to a display position control apparatus for generating a display position control signal to control (define) a display position of an image in the vertical direction in a PDP when a motion picture is displayed using the PDP serving as display device.

The display position control apparatus is usually disposed in an image signal processing IC (Integrated Circuit) in the PDP.

(I) First Embodiment

A first embodiment according to the present invention will now be described with reference to FIGS. 1 to 4.

Figure 1:
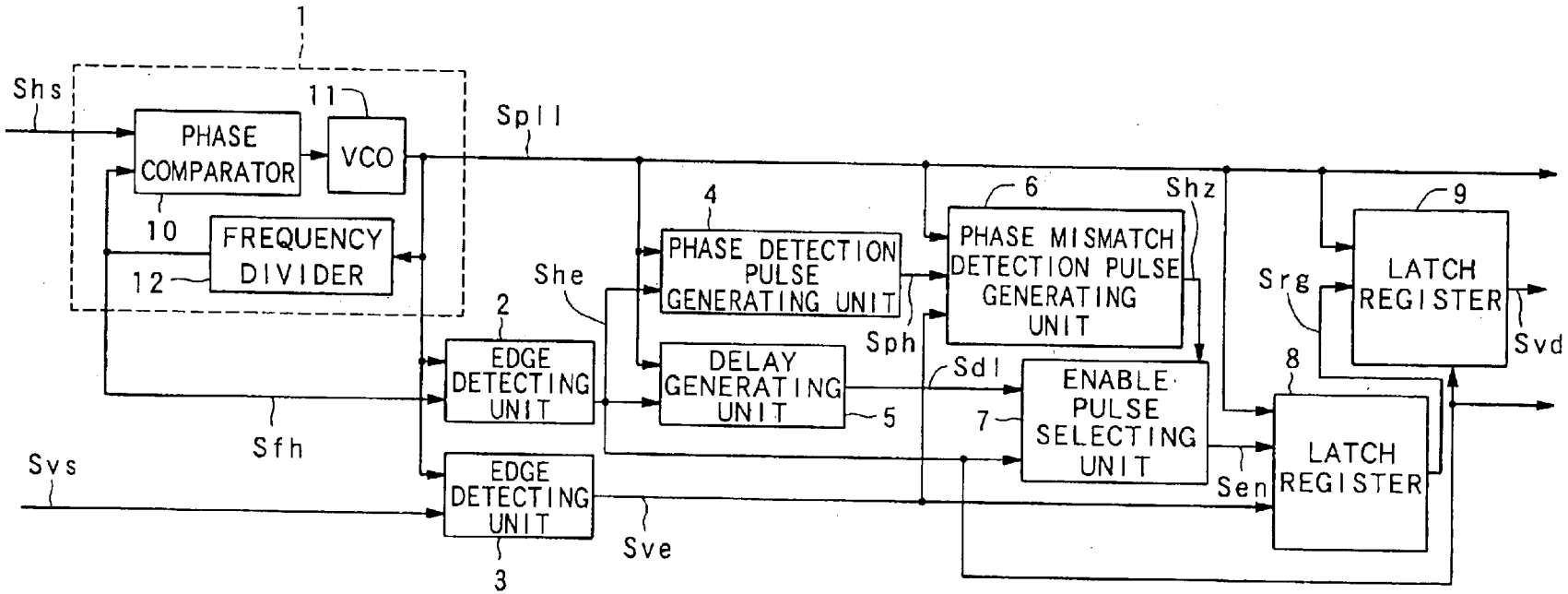
FIG. 1 is a block diagram showing a schematic constitution of a display position control apparatus according to a first embodiment.
Figure 2:
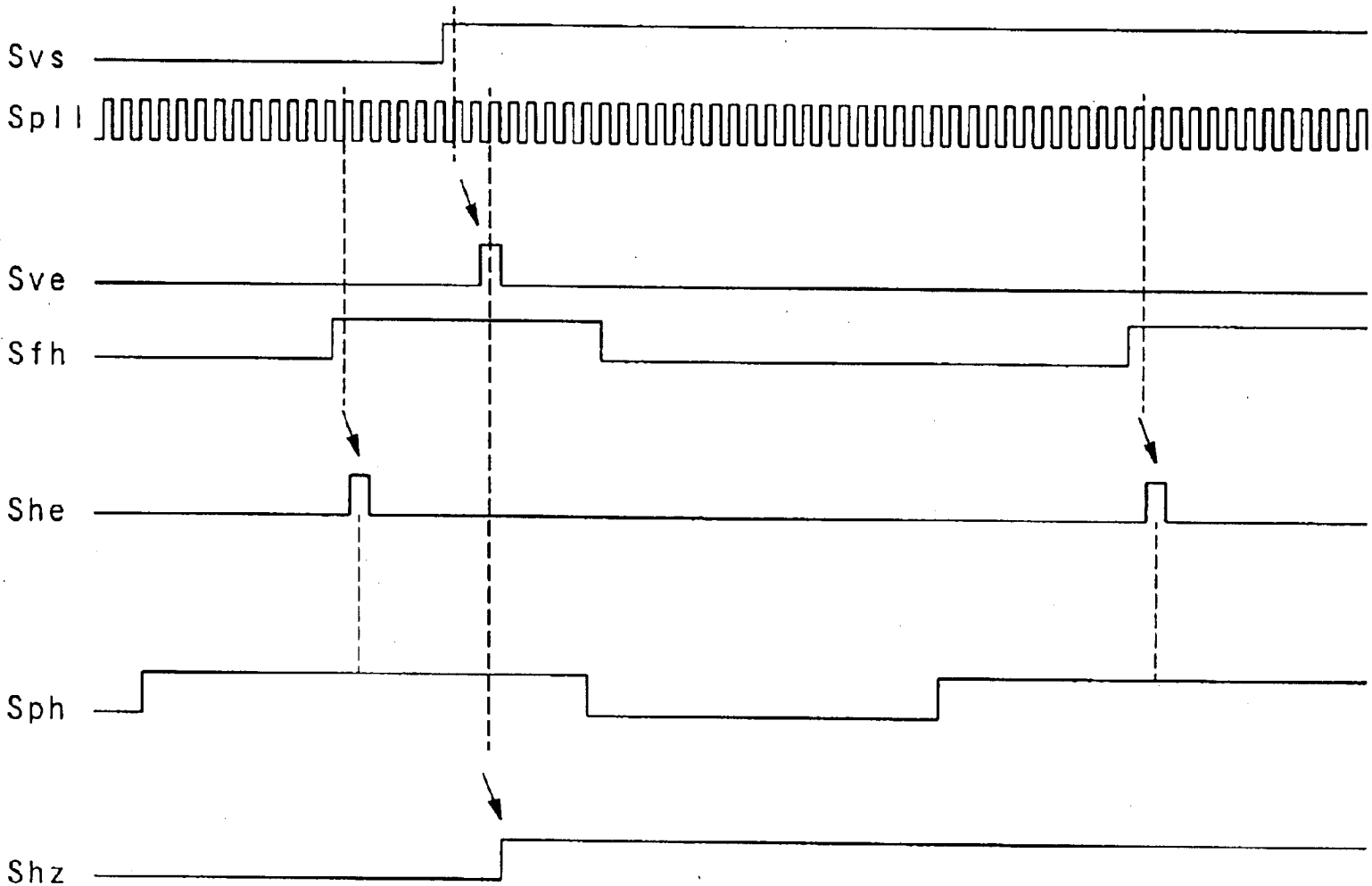
FIG. 2 is a timing chart showing the operation of the display position control apparatus according to the first embodiment.
Figure 3:
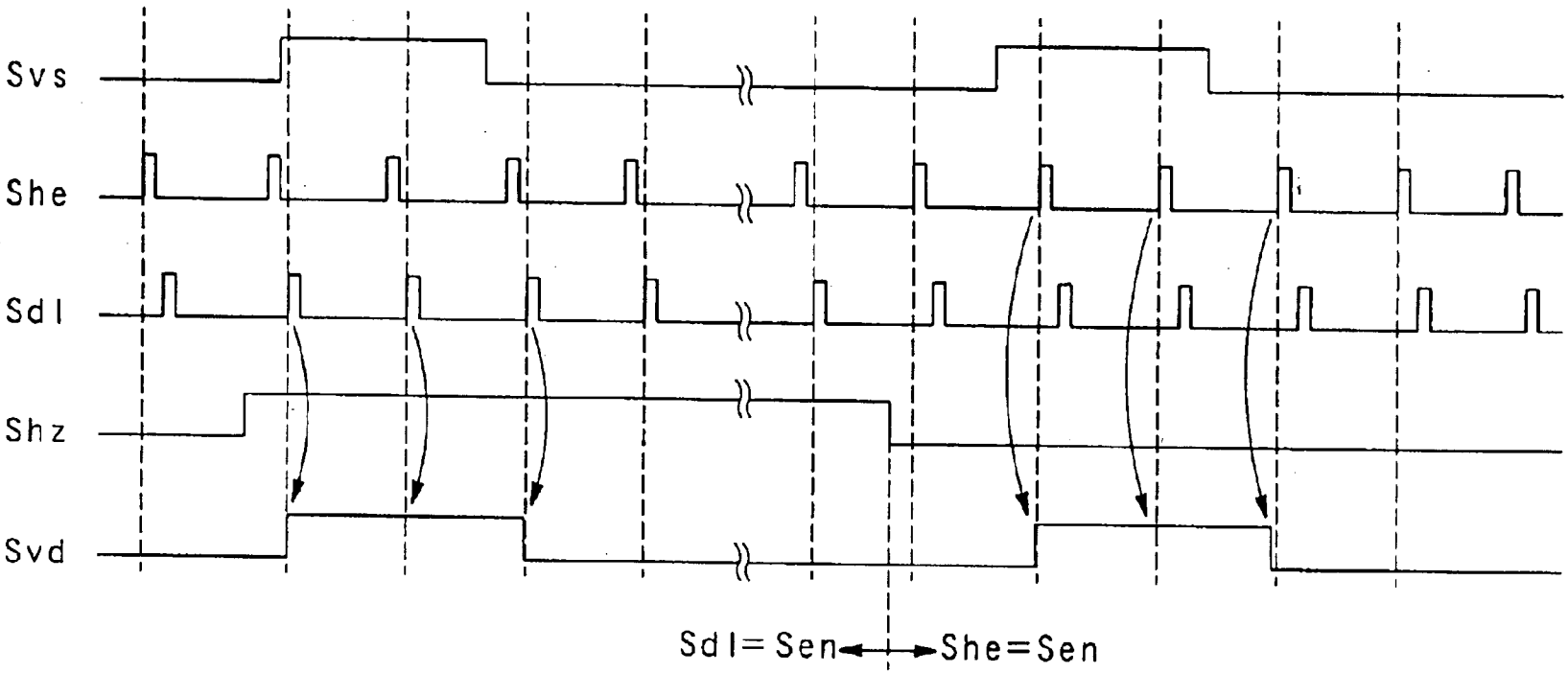
FIG. 3 is a timing chart showing the operation of the display position control apparatus according to the first embodiment.
Figure 4:
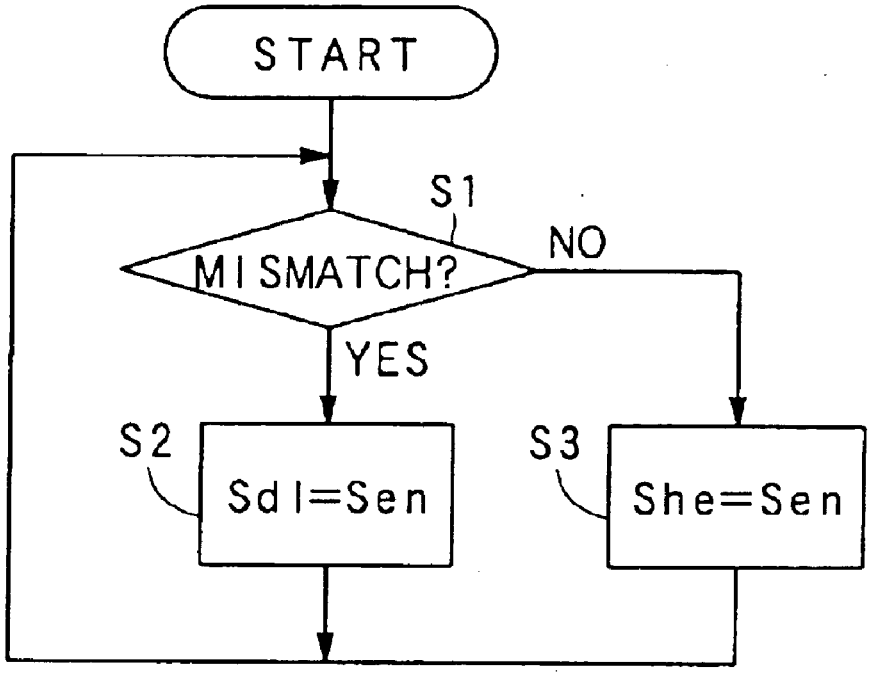
FIG. 4 is a flowchart showing the operation of the display position control apparatus according to the first embodiment.

FIG. 1 is a block diagram showing a schematic constitution of a display position control apparatus according to the first embodiment, FIGS. 2 and 3 are timing charts showing the operation of the display position control apparatus, and FIG. 4 is a flowchart showing the operation of the display position control apparatus.

As shown in FIG. 1, a display position control apparatus S includes: a PLL (Phase Locked Loop) unit 1 comprising a phase comparator 10, a VCO (Voltage Controlled Oscillator) 11, and a frequency divider 12; edge detecting units 2 and 3; a phase detection pulse generating unit 4 serving as mismatch detection signal generating device; a delay generating unit 5 serving as sync signal generating device; a phase mismatch detection pulse generating unit 6 serving as detecting device and determining device; an enable pulse selecting unit 7 serving as control signal generating device; and latch registers 8 and 9.

The operation will now be described.

First, a vertical sync signal and a horizontal sync signal as references to control a display position of an image in the PDP are supplied independently as a vertical sync signal Svs and a horizontal sync signal Shs from the outside to the display position control apparatus S.

On the basis of the horizontal sync signal Shs, the PLL unit 1 generates a PLL signal Spll serving as a reference clock signal in the overall operation of the display position control apparatus S and then outputs the PLL signal Spll to the edge detecting units 2 and 3, the phase detection pulse generating unit 4, the delay generating unit 5, the phase mismatch detection pulse generating unit 6, the latch registers 8 and 9, and another signal processing circuit (not shown) connected to the subsequent stage of the display position control apparatus S according to the embodiment. The PLL unit 1 also generates a frequency-divided horizontal sync signal Sfh obtained by dividing the frequency of the PLL signal Spll at a frequency division ratio n, which is preset (or set and input from the outside), and then outputs this signal to the edge detecting unit 2.

In this instance, more specifically, the phase comparator 10 in the PLL unit 1 detects a phase difference between the phase of the inputted horizontal sync signal Shs and the phase of the frequency-divided horizontal sync signal Sfh fed back through the frequency divider 12, and then outputs the detection result to the VCO 11. The VCO 11 generates the PLL signal Spll having such a phase as to cancel out the phase difference in the detection result, and then outputs the signal Spll to the edge detecting units 2 and 3 and the frequency divider 12. Consequently, the frequency divider 12 divides the frequency of the PLL signal Spll by a factor of n, generates the frequency-divided horizontal sync signal Sfh, and then outputs the signal to the edge detecting unit 2 and the phase comparator 10.

Subsequently, the edge detecting unit 2 detects timing at the rising edge of the frequency-divided horizontal sync signal Sfh using the PLL signal Spll, generates an edge detection signal She indicative of the timing, and then outputs the signal She to the enable pulse selecting unit 7, the delay generating unit 5, the phase detection pulse generating unit 4, the latch register 9, and the foregoing other external signal processing circuit.

Concurrently with the above, the edge detecting unit 3 detects timing at the rising edge of the vertical sync signal Svs using the PLL signal Spll, generates an edge detection signal Sve indicative of the timing, and then outputs the signal Sve to the latch register 8 and the phase mismatch detection pulse generating unit 6.

Subsequently, the delay generating unit 5 delays one pulse included in the edge detection signal She as much as the number of pulses of the PLL signal Spll preset (or set and inputted from the outside) to generate a delay signal Sdl, and then the signal Sdl to the enable pulse selecting unit 7.

In this instance, the amount of delay in the delay generating unit 5, namely, the number of pulses of the PLL signal Spll used for delay in the delay generating unit 5 is set so that a phase difference between the pulse of the edge detection signal Sve and the corresponding pulse of the delayed delay signal Sdl turns to a match state preset (or set and inputted from the outside) (in other words, a match state corresponding to a phase difference between the horizontal sync signal Shs and the vertical sync signal Svs which cannot turn to the mismatch state).

On the other hand, the phase detection pulse generating unit 4 generates a phase detection pulse signal Sph, which serves as a phase detection pulse in which timing of the pulse of the edge detection signal She is set to the center timing and which includes a phase detection pulse having a pulse width corresponding to several pulses of the PLL signal Spll before and after the pulse of the edge detection signal She on a time axis, and then outputs the signal Sph to the phase mismatch detection pulse generating unit 6.

At that time, for the pulse width of the phase detection pulse, when the timing of the pulse of the edge detection signal Sve is included for a period corresponding to the pulse width, the pulse width is recognized as a pulse width in which the mismatch state is caused.

Accordingly, the phase mismatch detection pulse generating unit 6 checks whether the timing of the pulse of the edge detection signal Sve is included in the pulse width of the phase detection pulse signal Sph every clock timing of the PLL signal Spll. The unit 6 generates a mismatch detection signal Shz, which goes to a level "HIGH" for a period during which the timing of the pulse of the edge detection signal Sve is included in the pulse width of the detection pulse signal Sph and which indicates that the vertical sync signal Svs and the horizontal sync signal Shs are in the mismatch state for this period, and then outputs the signal Shs to the enable pulse selecting unit 7.

In this instance, the generation of the mismatch detection signal Shz will now be described in more detail with reference to FIG. 2.

First, in the edge detecting unit 3, as shown in the uppermost stage or the third stage from the top in FIG. 2, the rising edge of the vertical sync signal Svs is detected on the basis of the PLL signal Spll. The edge detection signal Sve indicative of the rising edge is outputted to the phase mismatch detection pulse generating unit 6.

On the other hand, in the edge detecting unit 2, as shown in the fourth and fifth stages from the top in FIG. 2, the rising edge of the frequency-divided horizontal sync signal Sfh is detected on the basis of the PLL signal Spll. The edge detection signal She indicative of the rising edge is outputted to the phase detection pulse generating unit 4.

In the phase detection pulse generating unit 4, as shown in the second stage from the bottom in FIG. 2, the phase detection pulse having the above-mentioned pulse width in which the edge detection signal She is set to the center pulse is generated. This phase detection pulse is outputted as the phase detection pulse signal Sph to the phase mismatch detection pulse generating unit 6.

Accordingly, in the phase mismatch detection pulse generating unit 6, as shown in the lowermost stage in FIG. 2, the mismatch detection signal Shz is generated on the basis of the PLL signal Spll. When the pulse of the edge detection signal Sve enters the pulse width of the phase detection pulse, the mismatch detection signal Shz goes to the level "HIGH" at timing of the pulse of the PLL signal Spll generated for a period during which the pulse of the edge detection signal Sve is at the level "HIGH", and is then continuously held at the level "HIGH" until the pulse of the edge detection signal Sve does not enter the pulse width of the phase detection pulse. The signal Shz is outputted to the enable pulse selecting unit 7.

The enable pulse selecting unit 7 outputs the delay signal Sdl, serving as an enable signal Sen for the latch register 8, to the latch register 8 for a period during which the mismatch detection signal Shz is at the level "HIGH", and outputs the edge detection signal She as the enable signal Sen to the latch register 8 for a period during which the mismatch detection signal Shz is at a level "LOW".

Consequently, on the basis of the PLL signal Spll, the latch register 8 latches the edge detection signal Sve at timing at which the enable signal Sen is inputted, generates a register signal Srg serving as an original signal for a display position control signal Svd indicative of the display position of an image in the vertical direction in the PDP, and then outputs the signal Srg to the latch register 9.

Finally, in the latch register 9, on the basis of the PLL signal Spll, the register signal Srg is also latched at timing at which the edge detection signal She is inputted, and then the latched signal Srg as the display position control signal Svd is outputted to the foregoing other external signal processing circuit and a PDP main body (not shown).

In this instance, the reason why the edge detection signal Sve is latched twice using the latch registers 8 and 9 to generate the display position control signal Svd as mentioned above will now be described.

In the first embodiment described so far, the vertical sync signal Svs is latched using the edge detection signal She and the delay signal Sdl in order to finally generate the display position control signal Svd, which has a preset certain phase relation with the horizontal sync signal Shs and the vertical sync signal Svs, the edge detection signal She, and the PLL signal Spll. In this case, each of the edge detection signal She and the delay signal Sdl originally includes a phase shift with respect to the vertical sync signal Svs. Accordingly, when the vertical sync signal Svs is latched once using the edge detection signal She and the delay signal Sdl, the above-mentioned certain phase relation cannot be obtained. According to the present first embodiment, therefore, the register signal Srg (namely, the vertical sync signal Svs) is finally latched again using the edge detection signal She as an enable signal in the latch register 9, so that the display position control signal Svd is obtained.

The above series of operations will now be described in a lump in detail with reference to FIGS. 3 and 4.

According to the above-mentioned operation of the display position control apparatus S, for a period during which the mismatch detection signal Shz shown at the second stage from the bottom in FIG. 3 is at the level "HIGH", the vertical sync signal Svs shown at the uppermost stage in FIG. 3 is latched by the delay signal Sdl shown at the third stage from the bottom in FIG. 3. Accordingly, as shown at the lowermost stage in FIG. 3, the display position control signal Svd has the following waveform. That is, for a period during which the mismatch detection signal Shz is at the level "HIGH", the display position control signal Svd goes from the level "LOW" to the level "HIGH" at timing of the delay signal Sdl just after the vertical sync signal Svs changes from the level "LOW" to the level "HIGH". Then, the signal Svd is held at the level "HIGH". After that, the signal Svd changes from the level "HIGH" to the level "LOW" at timing of the delay signal Sdl just after the vertical sync signal Svs goes from the level "HIGH" to the "LOW" level.

On the other hand, after the mismatch detection signal Shz changes from the level "HIGH" to the level "LOW", the vertical sync signal Svs is latched by the edge detection signal She shown at the second stage from the top in FIG. 3. Consequently, as shown at the lowermost stage in FIG. 3, the display position control signal Svd has the following waveform. That is, after the mismatch detection signal Shz goes from the level "HIGH" to the level "LOW", the display position control signal Svd changes from the level "LOW" to the level "HIGH" at timing of the edge detection signal She just after the vertical sync signal Svs goes from the level "LOW" to the level "HIGH", and is then held at the level "HIGH". After that, the signal Svd goes from the level "HIGH" to the level "LOW" at timing of the edge detection signal She just after the vertical sync signal Svs changes from the level "HIGH" to the level "LOW".

As a processing in the enable pulse selecting section 7 at that time, as shown in a flowchart in FIG. 4, whether the vertical sync signal Svs and the horizontal sync signal Shs are in the mismatch state is always monitored on the basis of whether the mismatch detection signal Shz is at the level "HIGH" (step S1). When the mismatch state is caused, namely, the mismatch detection signal Shz is at the level "HIGH" (YES in step S1), the delay signal Sdl is outputted as the enable signal Sen to the latch register 8 (step S2). On the other hand, when the mismatch state is not caused, namely, the mismatch detection signal Shz is at the level "LOW" (NO in step S1), the edge detection signal She is outputted as the enable signal Sen to the latch register 8 (step S3).

In the above description regarding the first embodiment, the case where each of the vertical sync signal Svs and the horizontal sync signal Shs has a positive polarity has been described. In the case where the polarity of each of the vertical sync signal Svs and the horizontal sync signal Shs indicates negative, when "rising edge" is changed for "falling edge", "HIGH" is changed for "LOW", and "LOW" is changed for "HIGH" in the description regarding the operations of the edge detecting units 2 and 3, the delay generating unit 5, the phase detection pulse generating unit 4, the phase mismatch detection pulse generating unit 6, the enable pulse selecting unit 7, and the latch registers 8 and 9, the respective components in case of the negative polarity can be explained.

As mentioned above, in the operation of the display position control apparatus S according to the first embodiment, the delay signal Sdl having a phase difference in the match state with respect to the vertical sync signal Svs is generated. When it is detected that the phase relation between the vertical sync signal Svs and the horizontal sync signal Shs is in the mismatch state, the display position control signal Svd is generated on the basis of the vertical sync signal Svs and the delay signal Sdl. When it is not detected that the phase relation is in the mismatch state, the display position control signal Svd is generated on the basis of the vertical sync signal Svs and the horizontal sync signal Shs. Accordingly, the display position control signal Svd can be generated by always using any signal, which is in the match state with respect to the vertical sync signal Svs. Consequently, it is possible to prevent the instability of switching timing of the display position control signal Svd caused by the fact that the phase relation between the vertical sync signal Svs and the horizontal sync signal Shs is in the mismatch state.

For the relation with the mismatch detection signal Shz generated on the basis of the horizontal sync signal Shs, when the timing of one pulse of the edge detection signal Sve is included within a range of the pulse width of the phase detection pulse signal Sph, it is determined that the phase relation is in the mismatch state. When the timing of one pulse of the edge detection signal Sve is not included within the range, it is determined that the phase relation is not in the mismatch state. Consequently, the mismatch state of the phase relation can surely be detected with a simple constitution.

Furthermore, the mismatch detection signal Shz is generated using the timing of one pulse of the edge detection signal She as the center timing. Accordingly, the mismatch state of the phase relation can be detected using a period before and after the pulse of the horizontal sync signal Shs as an object.

(II) Second Embodiment

A second embodiment as another embodiment according to the present invention will now be described with reference to FIGS. 5 to 9.

Figure 5:
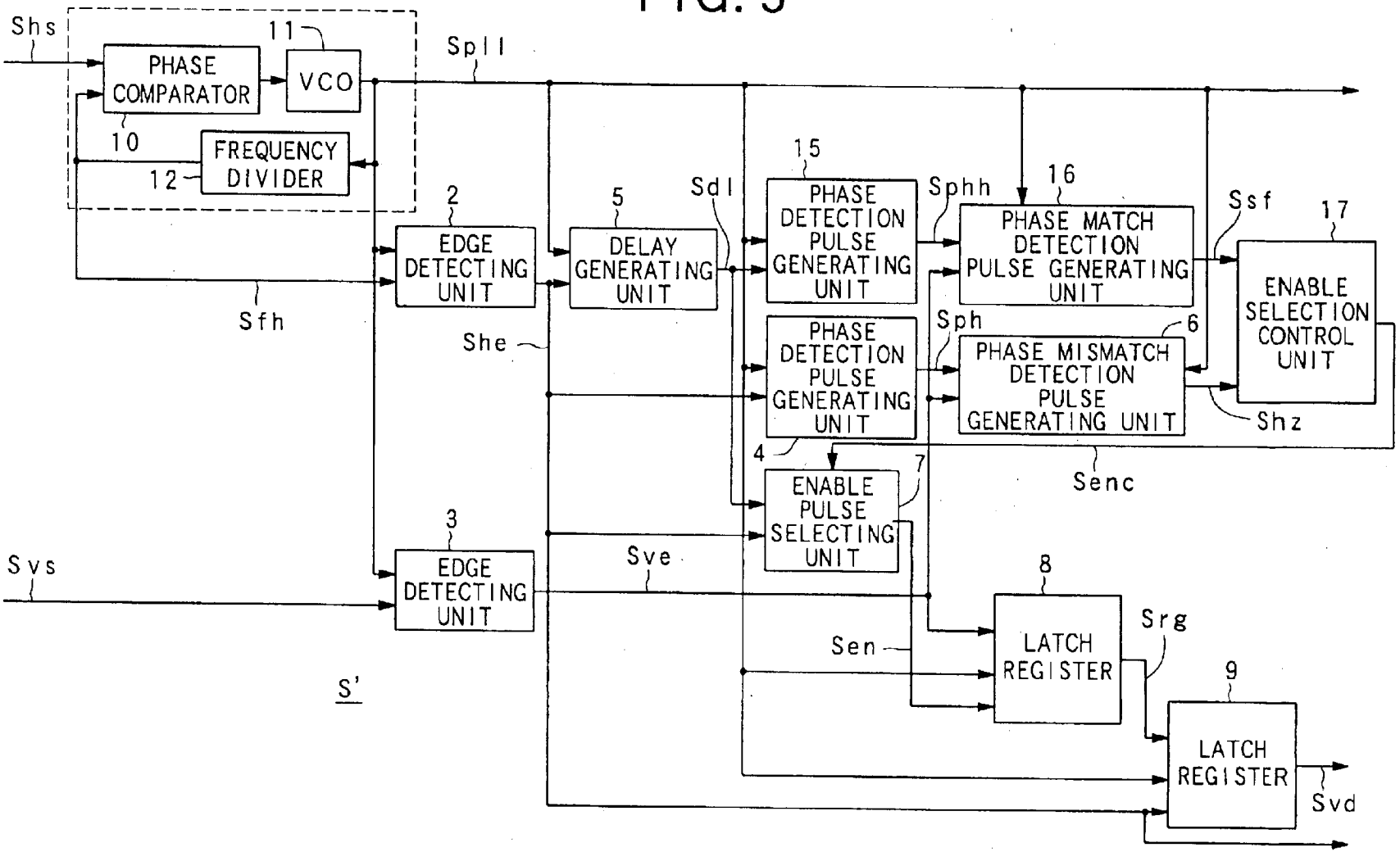
FIG. 5 is a block diagram showing a schematic constitution of a display position control apparatus according to a second embodiment.
Figure 6:
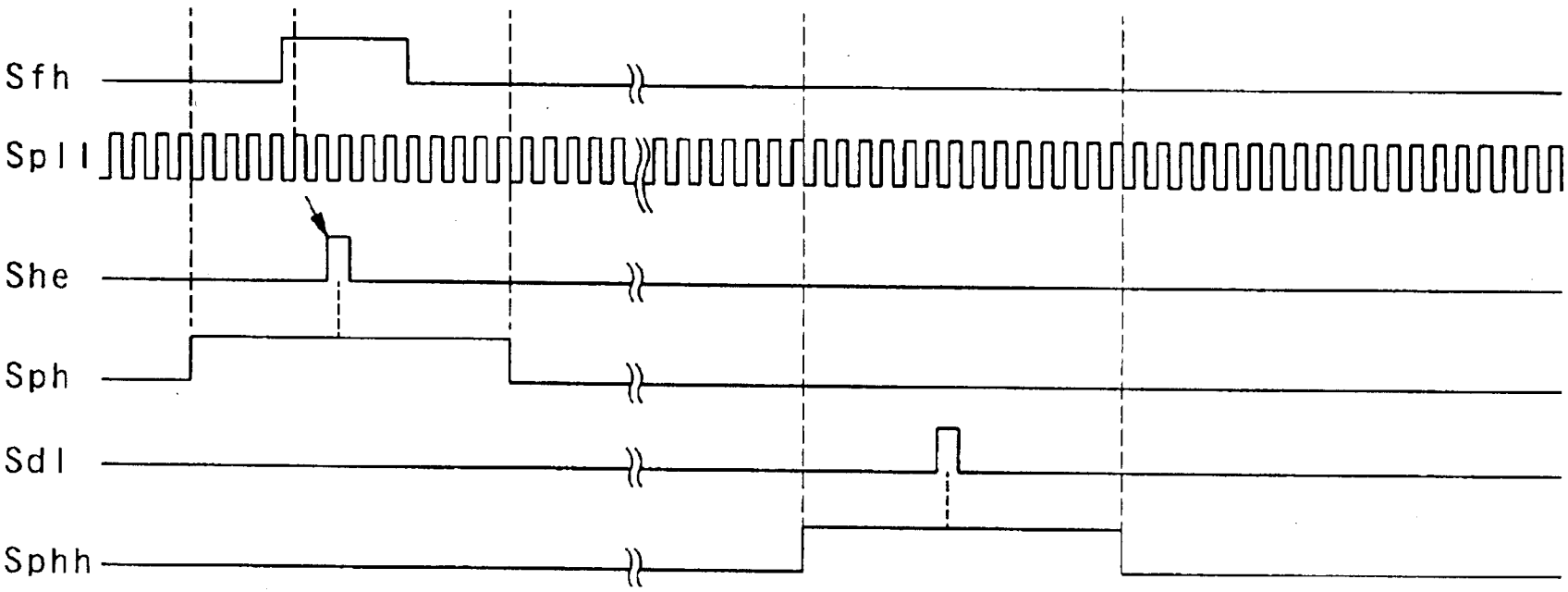
FIG. 6 is a timing chart showing the operation of the display position control apparatus according to the second embodiment.
Figure 8:
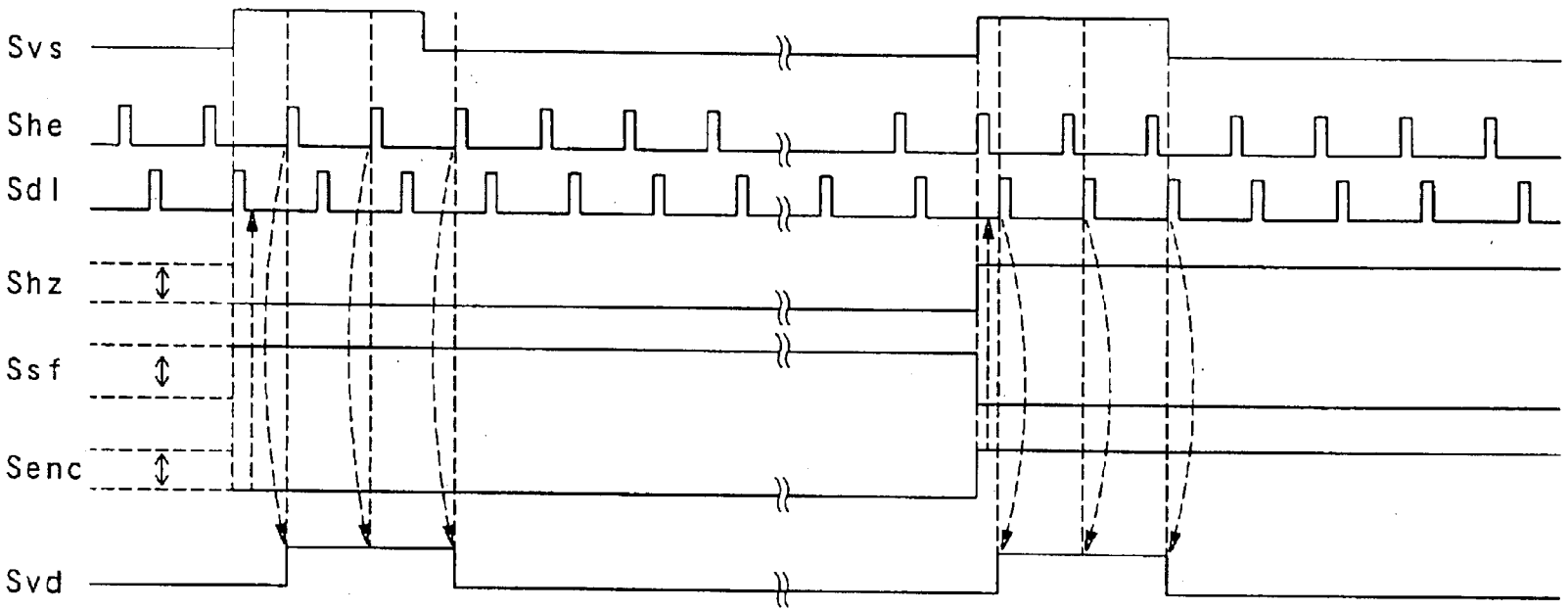
FIG. 8 is a timing chart showing the operation of the display position control apparatus according to the second embodiment.
Figure 9:
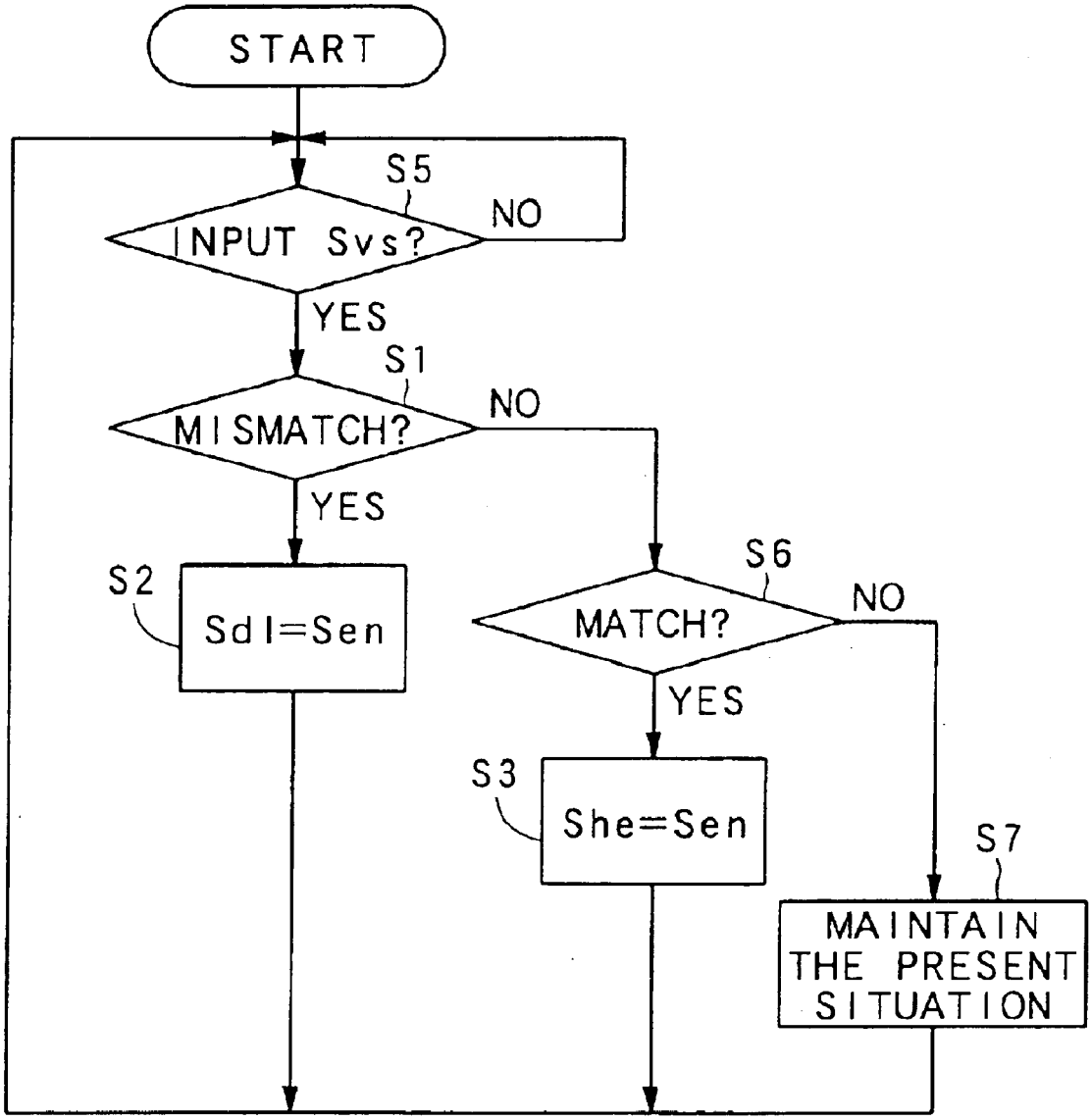
FIG. 9 is a flowchart showing the operation of the display position control apparatus according to the second embodiment.

FIG. 5 is a block diagram showing a schematic constitution of a display position control apparatus according to the second embodiment. FIGS. 6 to 8 are timing charts showing the operation of the display position control apparatus. FIG. 9 is a flowchart showing the operation of the display position control apparatus.

In the block diagram shown in FIG. 5, the same reference numerals denote the same components as those of the display position control apparatus S according to the first embodiment and the detailed description is omitted.

According to the foregoing first embodiment, the following constitution has been described. That is, when it is detected that the phase relation between the vertical sync signal Svs and the horizontal sync signal Shs is in the mismatch state, the vertical sync signal Svs is latched using the delay signal Sdl to generate the display position control signal Svd. When it is not detected that the phase relation between the vertical sync signal Svs and the horizontal sync signal Shs is in the mismatch state, the vertical sync signal Svs is latched using the edge detection signal She to generate the display position control signal Svd.

On the other hand, according to the second embodiment, in addition to the situation in which the phase relation between the vertical sync signal Svs and the horizontal sync signal Shs is in the mismatch state, such a situation that the phase relation between the vertical sync signal Svs and the horizontal sync signal Shs is in the match state is also detected actively. The generation of the display position control signal Svd using the delay signal Sdl and the generation of the display position control signal Svd using the edge detection signal She can be switched to each other in a more stable state.

In other words, as shown in FIG. 5, in addition to the components of the display position control apparatus S shown in FIG. 1, a display position control apparatus S' according to the second embodiment further includes a phase detection pulse generating unit 15 serving as match detection signal generating device, a phase match detection pulse generating unit 16 serving as second detecting device and second determining device, and an enable selection control unit 17. The enable pulse selecting unit 7 serving as second control signal generating device selects the enable signal Sen using a selection signal Senc, which will be described below, as a switching signal from the enable selection control unit 17.

The PLL signal Spll and the delay signal Sdl are inputted to the phase detection pulse generating unit 15. On the other hand, a phase detection pulse signal Sphh, which will be described below, the PLL signal Spll, and the edge detection signal Sve are inputted to the phase match detection pulse generating unit 16.

Further, the mismatch detection signal Shz from the phase mismatch detection pulse generating unit 6 and a match detection signal Ssf, which will be described below, from the phase match detection pulse generating unit 16 are supplied to the enable selection control unit 17. The selection signal Senc from the enable selection control unit 17 is inputted to the enable pulse selecting unit 7.

The operation will now be described.

First, the PLL unit 1 generates the PLL signal Spll in a manner similar to the first embodiment and then outputs the signal Spll to the edge detecting units 2 and 3, the phase detection pulse generating units 4 and 15, the delay generating unit 5, the phase mismatch detection pulse generating unit 6, the phase match detection pulse generating unit 16, the latch registers 8 and 9, and the foregoing other external signal processing circuit. The PLL unit 1 similarly generates the frequency-divided horizontal sync signal Sfh and then outputs the signal to the edge detecting unit 2.

Subsequently, the edge detecting unit 2 generates the edge detection signal She in a manner similar to the first embodiment and then outputs the signal She to the enable pulse selecting unit 7, the delay generating unit 5, the phase detection pulse generating unit 4, and the foregoing other external signal processing circuit.

Concurrently with the above, the edge detecting unit 3 generates the edge detection signal Sve in a manner similar to the first embodiment and then outputs the signal Sve to the latch register 8, the phase mismatch detection pulse generating unit 6, and the phase match detection pulse generating unit 16.

Subsequently, the delay generating unit 5 generates the delay signal Sdl in a manner similar to the first embodiment and then outputs the signal Sdl to the enable pulse selecting unit 7 and the phase detection pulse generating unit 15.

On the other hand, the phase detection pulse generating unit 4 generates the phase detection pulse signal Sph in a manner similar to the first embodiment and then outputs the signal Sph to the phase mismatch detection pulse generating unit 6.

Concurrently with the above, the phase detection pulse generating unit 15 generates the phase detection pulse signal Sphh. The signal Sphh serves as a phase detection pulse in which timing of the pulse of the delay signal Sdl is set to the center timing and includes a second phase detection pulse having a pulse width corresponding to the several pulses of the PLL signal Spll before and after the pulse of the delay signal Sdl on the time axis. The phase detection pulse generating unit 15 outputs the signal Sphh to the phase match detection pulse generating unit 16.

At that time, for the pulse width of the second phase detection pulse, when the timing of the pulse of the edge detection signal Sve is included for a period corresponding to the pulse width, the pulse width is recognized as a pulse width in which the match state is caused.

Accordingly, the phase mismatch detection pulse generating unit 6 generates the mismatch detection signal Shz similar to that of the first embodiment. That is, when the pulse of the edge detection signal Sve enters the pulse width of the foregoing phase detection pulse, the mismatch detection signal Shz goes from a logical value so far (at either the level "HIGH" or the level "LOW": the same applies to those that follow) to the level "HIGH" at timing of the pulse of the PLL signal Spll generated for a period during which the pulse of the edge detection signal Sve is at the level "HIGH", the logical value at the level "HIGH" is then held, and the signal Shz goes from the level "HIGH" to the level "LOW" at the timing of the pulse of the PLL signal Spll generated for a period during which the pulse of the edge detection signal Sve is at the level "HIGH", the signal Sve being inputted just after the pulse of the edge detection signal Sve does not enter the pulse width of the phase detection pulse. The phase mismatch detection pulse generating unit 6 then outputs the mismatch detection signal Shz to the enable selection control unit 17.

On the other hand, the phase match detection pulse generating unit 16 checks whether the timing of the pulse of the foregoing edge detection signal Sve enters the pulse width of the phase detection pulse signal Sphh every clock timing of the PLL signal Spll and generates the match detection signal Ssf. When the pulse of the edge detection signal Sve enters the pulse width of the phase detection pulse signal Sphh, the match detection signal Ssf goes from a logical value so far to the level "HIGH" at timing of the pulse of the PLL signal Spll generated for a period during which the pulse of the edge detection signal Sve is at the level "HIGH", the logical value at the level "HIGH" is then held, and the match detection signal goes from the level "HIGH" to the level "LOW" at timing of the pulse of the PLL signal Spll generated for a period during which the pulse of the edge detection signal Sve is at the level "HIGH", the edge detection signal Sve being inputted just after the pulse of the edge detection signal Sve does not enter the pulse width of the second phase detection pulse. The phase match detection pulse generating unit 16 outputs the signal Ssf to the enable selection control unit 17.

On the basis of the logical value of the mismatch detection signal Shz and the logical value of the match detection signal Ssf, the enable selection control unit 17 generates the selection signal Senc indicating whether the latch register 8 latches the edge detection signal Sve (namely, the vertical sync signal Svs) using either the edge detection signal She or the delay signal Sdl by processing, which will be described later, and then outputs the signal Senc to the enable pulse selection unit 7.

In this instance, the generation of the mismatch detection signal Shz and the match detection signal Ssf will now be described in more detail with reference to FIG. 6.

First, the edge detecting unit 3 generates the edge detection signal Sve and then outputs the signal to the phase mismatch detection pulse generating unit 6 and the phase match detection pulse generating unit 16.

On the other hand, as shown in the second and third stages from the top in FIG. 6, the edge detecting unit 2 detects the rising edge of the frequency-divided horizontal sync signal Sfh on the basis of the PLL signal Spll and then outputs the edge detection signal She indicative of the rising timing to the phase detection pulse generating unit 4.

As shown in the third stage from the bottom in FIG. 6, the phase detection pulse generating unit 4 generates the phase detection pulse having the above-mentioned pulse width in which the edge detection signal She is set to the center pulse and then outputs the generated pulse as the phase detection pulse signal Sph to the phase mismatch detection pulse generating unit 6.

Consequently, on the basis of the PLL signal Spll, the phase mismatch detection pulse generating unit 6 generates the mismatch detection signal Shz. When the pulse of the edge detection signal Sve enters the pulse width of the phase detection pulse, the mismatch detection signal Shz goes to the level "HIGH" at timing of the pulse of the PLL signal Spll generated for a period during which the pulse of the edge detection signal Sve is at the level "HIGH" and is then held at the level "HIGH" until the pulse of the edge detection signal Sve does not enter the pulse width of the phase detection pulse. The phase mismatch detection pulse generating unit 6 outputs the signal Shz to the enable selection control unit 17.

On the other hand, as shown at the second stage from the bottom and the lowermost stage in FIG. 6, the phase detection pulse generating unit 15 generates the second phase detection pulse having the foregoing pulse width, in which the delay signal Sdl from the delay generating unit 5 is set to the center pulse, and then outputs the second phase detection pulse as the phase detection pulse signal Sphh to the phase match detection pulse generating unit 16.

Consequently, on the basis of the PLL signal Spll, the phase match detection pulse generating unit 16 generates the match detection signal Ssf. When the pulse of the edge detection signal Sve enters the pulse width of the second phase detection pulse, the match detection signal Ssf goes to the level "HIGH" at timing of the pulse of the PLL signal Spll generated for a period during which the pulse of the edge detection signal Sve is at the level "HIGH", and is then held at the level "HIGH" until the pulse of the edge detection signal Sve does not enter the pulse width of the second phase detection pulse. The phase match detection pulse generating unit 16 outputs the signal Ssf to the enable selection control unit 17.

In this instance, the operations of the phase detection pulse generating units 4 and 15, the phase mismatch detection pulse generating unit 6, and the phase match detection pulse generating unit 16, particularly, the mutual relation therebetween will now be described hereinbelow with reference to FIGS. 7A to 7C.

Figure 7A:
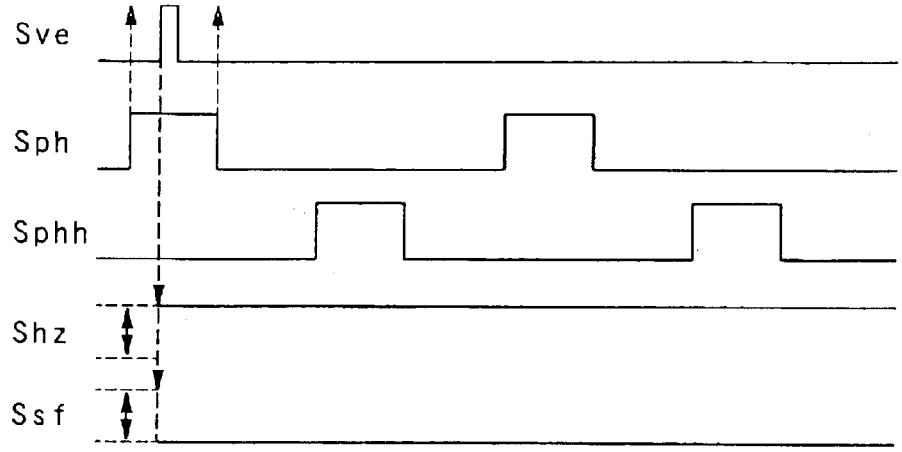
FIGS. 7A to 7C are timing charts showing the operation of the display position control apparatus according to the second embodiment, FIG. 7A showing a first example, FIG. 7B showing a second example, and FIG. 7C showing a third example.

First, as shown in FIG. 7A, when the pulse of the edge detection signal Sve enters the pulse width of the phase detection pulse but does not enter the pulse width of the second phase detection pulse, the phase mismatch detection pulse generating unit 6 generates the mismatch detection signal Shz. The signal Shz goes from a logical value so far to the level "HIGH" at timing of the pulse of the PLL signal Spll, at which the pulse of the edge detection signal Sve is at the level "HIGH", and is then held at the logical value at the level "HIGH". The phase mismatch detection pulse generating unit 6 outputs the signal Shz to the enable selection control unit 17. Concurrently with the above, the phase match detection pulse generating unit 16 generates the match detection signal Ssf. The signal Ssf goes to the level "LOW" at the same timing as the timing at which the logical value of the mismatch detection signal Shz goes to the level "HIGH", and is then held at the logical value at the level "LOW". The phase match detection pulse generating unit 16 outputs the signal Ssf to the enable selection control unit 17.

Figure 7B:
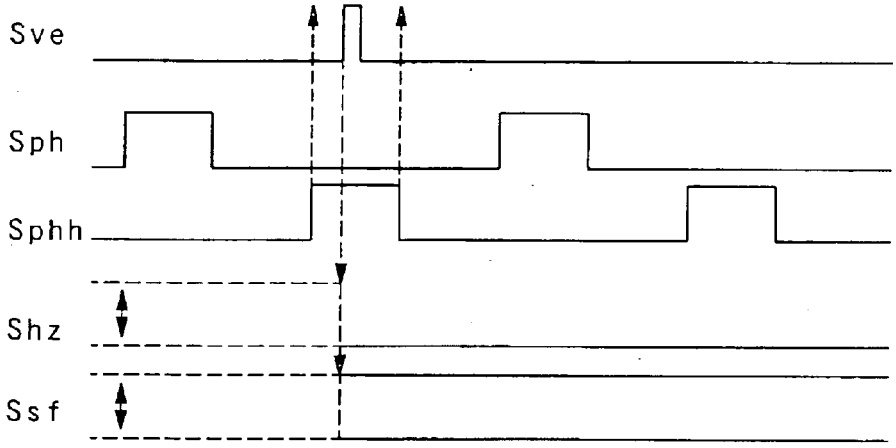

Subsequently, secondly, as shown in FIG. 7B, when the pulse of the edge detection signal Sve does not enter the pulse width of the phase detection pulse but enters the pulse width of the second phase detection pulse, the phase match detection pulse generating unit 16 generates the match detection signal Ssf. The signal Ssf goes from a logical value so far to the level "HIGH" at the timing of the pulse of the PLL signal Spll at which the pulse of the edge detection signal Sve is at the level "HIGH", and is then held at the logical value at the level "HIGH". The phase match detection pulse generating unit 16 outputs the signal Ssf to the enable selection control unit 17. Concurrently with the above, the phase mismatch detection pulse generating unit 6 generates the mismatch detection signal Shz. The signal Shz goes to the level "LOW" at the same timing as the timing at which the logical value of the match detection signal Ssf goes to the level "HIGH" and is then held at the logical value at the level "LOW". The phase mismatch detection pulse generating unit 6 outputs the signal Shz to the enable selection control unit 17.

Figure 7C:
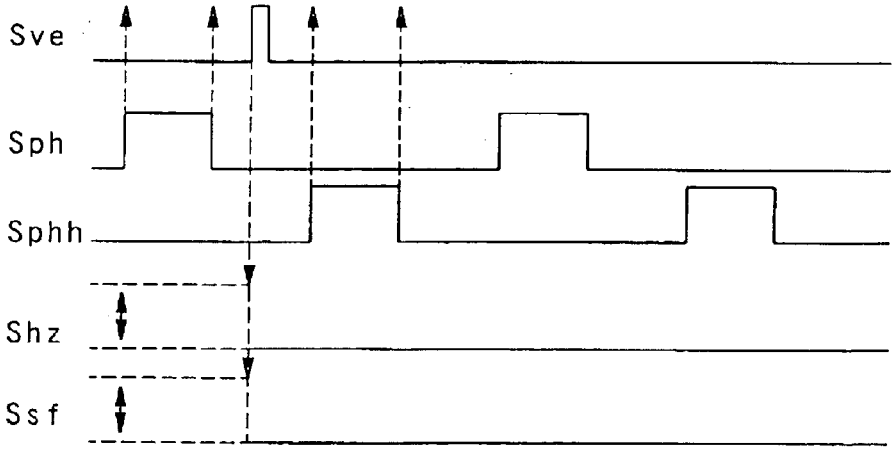

Finally, thirdly, as shown in FIG. 7C, when the pulse of the edge detection signal Sve does not enter the pulse width of the phase detection pulse and also does not enter the pulse width of the second phase detection pulse, the phase match detection pulse generating unit 16 generates the match detection signal Ssf. The signal Ssf goes from a logical value so far to the level "LOW" at the timing of the pulse of the PLL signal Spll at which the pulse of the edge detection signal Sve is at the level "HIGH", and is then held at the logical value at the level "LOW". The phase match detection pulse generating unit 16 outputs the signal Ssf to the enable selection control unit 17. Concurrently with the above, the phase mismatch detection pulse generating unit 6 generates the mismatch detection signal Shz. The signal Shz goes to the level "LOW" at the same timing as the timing at which the logical value of the match detection signal Ssf goes to the level "LOW", and is then held at the logical value at the level "LOW". The phase mismatch detection pulse generating unit 16 outputs the signal Shz to the enable selection control unit 17.

As is clear from the above description, it is impossible to generate such a phenomenon that the pulse of the edge detection signal Sve enters both of the pulse width of the phase detection pulse and the pulse width of the second phase detection pulse because a horizontal synchronization frequency included in a normal video signal is hundreds times as high as the corresponding vertical synchronization frequency.

Subsequently, on the basis of the logical value of the match detection signal Ssf and the logical value of the mismatch detection signal Shz, when the logical value of the match detection signal Ssf is at the level "LOW" and the logical value of the mismatch detection signal Shz is at the level "HIGH", the enable selection control unit 17 generates the selection signal Senc which has a logical value at the level "HIGH" and then outputs the signal Senc to the enable pulse selecting unit 7. On the other hand, when the logical value of the match detection signal Ssf is at the level "HIGH" and the logical value of the mismatch detection signal Shz is at the level "LOW", the enable selection control unit 17 generates the selection signal Senc having a logical value at the level "LOW" and then outputs the signal Senc to the enable pulse selecting unit 7. Further, when both the logical values of the match detection signal Ssf and the mismatch detection signal Shz are at the level "LOW", the enable selection control unit 17 generates the selection signal Senc having a logical value which does not change from the logical value so far, and then outputs the signal Senc to the enable pulse selecting unit 7. In this instance, the logical value of the selection signal Senc changes to the above-mentioned logical value at the timing which the logical value of the selection signal Senc changes, depends on timing at which the logical value of the match detection signal Ssf or the logical value of the mismatch detection signal Shz changes.

The enable pulse selecting unit 7 outputs the delay signal Sdl, serving as the enable signal Sen for the latch register 8, to the latch register 8 for a period during which the logical value of the selection signal Senc is at the level "HIGH", and outputs the edge detection signal She as the enable signal Sen to the latch register 8 for a period during which the logical value of the selection signal Senc is at the level "HIGH".

Consequently, on the basis of the PLL signal Spll, the latch register 8 latches the edge detection signal Sve at timing at which the enable signal Sen is inputted, generates the register signal Srg, and then outputs the signal Srg to the latch register 9.

On the basis of the PLL signal Spll, in the latch register 9, the register signal Srg is also latched at timing at which the edge detection signal She is inputted to generate the display position control signal Svd indicative of the display position of an image in the vertical direction in the PDP. The signal Svd is outputted to the foregoing other external signal processing circuit and the PDP main body (not shown).

The above-mentioned series of operations will now be described in a lump in detail with reference to FIG. 8.

According to the operation of the above-mentioned display position control apparatus S', for a period during which the selection signal Senc shown at the second stage from the bottom in FIG. 8 is at the level "LOW", the vertical sync signal Svs shown at the left in the uppermost stage in FIG. 8 is latched by the edge detection signal She shown at the left in the second stage from the top in FIG. 8. Accordingly, as shown at the left in the lowermost stage in FIG. 8, the display position control signal Svd has the following waveform. That is, for a period during which the selection signal Senc is at the level "LOW", the display position control signal Svd goes from the level "LOW" to the level "HIGH" at timing of the edge detection signal She just after the vertical sync signal Svs changes from the level "LOW" to the level "HIGH", is then held at the level "HIGH", and after that, changes from the level "HIGH" to the level "LOW" at the timing of the edge detection signal She just after the vertical sync signal Svs goes from the level "HIGH" to the level "LOW".

On the other hand, for a period during which the selection signal Senc is at the level "HIGH", the vertical sync signal Svs shown at the right in the uppermost stage in FIG. 8 is latched by the delay signal Sdl shown at the right in the third stage from the top in FIG. 8. Consequently, as shown at the right at the lowermost stage in FIG. 8, the display position control signal Svd has the following waveform. That is, for a period during which the selection signal Senc is at the level "HIGH", the display position control signal Svd goes to the level "LOW" to the level "HIGH" at the timing of the delay signal Sdl just after the vertical sync signal Svs changes from the level "LOW" to the level "HIGH", is then held at the level "HIGH", and after that, goes from the level "HIGH" to the level "LOW" at the timing of the delay signal Sdl just after the vertical sync signal Svs changes from the level "HIGH" to the level "LOW".

As shown in FIG. 8, timing at which at least one of the logical value of the match detection signal Ssf and that of the mismatch detection signal Shz changes in the above-mentioned series of operations is the same as start timing of the vertical sync signal Svs (in other words, edge detection signal Sve).

For the processings in the phase detection pulse generating units 4 and 15, the phase mismatch detection pulse generating unit 6, the phase match detection pulse generating unit 16, and the enable pulse selecting unit 7 in the above steps, as shown in a flowchart in FIG. 9, whether the vertical sync signal Svs is inputted is first determined (step S5). When it is not inputted (NO in step S5), standby is held until the vertical sync signal Svs is inputted. On the other hand, when the signal Svs is inputted (YES in step S5), whether the vertical sync signal Svs and the horizontal sync signal Shs are in the mismatch state is always monitored on the basis of whether the selection signal Senc is at the level "HIGH" (step S1). When the mismatch state is caused, namely, the selection signal Senc is at the level "HIGH" (YES in step S1), the delay signal Sdl is outputted as the enable signal Sen to the latch register 8 (step S2). On the other hand, when the mismatch state is not caused, namely, the selection signal Senc is not at the level "HIGH" (NO in step S1), whether the vertical sync signal Svs and the horizontal sync signal Shs are in the match state is always monitored on the basis of whether the selection signal Senc is at the level "LOW" (step S6). When the match state is held, namely, the selection signal Senc is at the level "LOW" (YES in step S6), the edge detection signal She is outputted as the enable signal Sen to the latch register 8 (step S3). On the other hand, when the match state is not held, namely, the selection signal Senc is not at the level "LOW" (NO in step S6), the present state is held, the signal to be outputted as the enable signal Sen is not changed to another signal (step S7), and the signal is outputted to the latch register 8.

As mentioned above, according to the operation of the display position control apparatus S' of the second embodiment, in addition to the advantages of the display position control apparatus S of the first embodiment, the following advantages are obtained. The phase match detection pulse generating unit 16 for detecting whether the phase relation is in the match state is provided separately. When it is detected that the phase relation is in the match state, the display position control signal Svd is generated on the basis of the vertical sync signal Svs and the horizontal sync signal Shs. Consequently, even when the detection of the mismatch state is unstable, the display position control signal Svd can be generated in the state where the phase relation is more surely held in the match state.

For the relation with the phase detection pulse signal Sphh generated on the basis of the delay signal Sdl, when timing of one pulse of the vertical sync signal Svs is included within a range of the pulse width of the phase detection pulse signal Sphh, it is determined that the phase relation is in the match state. Accordingly, the match state of the phase relation can be detected more surely with a simple constitution.

Furthermore, since timing of one pulse of the delay signal Sdl is set to the center timing to generate the phase detection pulse signal Sphh, the match state of the phase relation can be detected by setting a period corresponding to pulses before and after the pulse of the delay signal Sdl to a subject.

In the above-mentioned first and second embodiments, the case where the display position of the image in the PDP is controlled using the generated display position control signal Svd has been explained. In addition to the above case, so long as the matrix type display apparatus is used, the present invention can also be applied to display position control in, for example, a liquid crystal display or an EL (Electro Luminescence) display in addition to the PDP.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2001-202696 filed on Jul. 3, 2001 including the specification, claims, drawings and summary is incorporated herein by reference in its entirety.

What is claimed is:

1. A display position control apparatus which uses a first sync signal to control a display position of an image in one direction of a matrix type display device and a second sync signal, which is different from the first sync signal, to control the display position of the image in another direction of the display device to generate a position control signal to control the display position of the image in the display device, comprising:

a sync signal generating device which generates a third sync signal having a phase difference held in a preset match state with respect to the phase of the first sync signal;

a detecting device which detects whether a phase relation between the phase of the first sync signal and the phase of the second sync signal is held in a preset mismatch state; and a control signal generating device which generates the position control signal on the basis of the first sync signal and the third sync signal when it is detected that the phase relation is in the mismatch state, and generates the position control signal on the basis of the first sync signal and the second sync signal when it is not detected that the phase relation is in the mismatch state, wherein the detecting device comprises:

a mismatch detection signal generating device which generates a mismatch detection signal having a preset pulse width on the basis of the second sync signal; and a determining device which determines that the phase relation is in the mismatch state when timing of one pulse of the first sync signal is included within a range of the pulse width of the generated mismatch detection signal, and determines that the phase relation is not in the mismatch state when the timing of one pulse of the first sync signal is not included within the range.

2. The apparatus according to claim 1, wherein the mismatch detection signal generating device generates the mismatch detection signal having the pulse width in which timing of one pulse of the second sync signal is set to the center timing.

3. The apparatus according to claim 1, wherein:

the detecting device is a first detecting device;

the control signal generating device is a first control signal generating device; and the apparatus further comprises:

a second detecting device which detects whether the phase relation between the phase of the first sync signal and the phase of the second sync signal is in the match state; and a second control signal generating device which generates the position control signal on the basis of the first sync signal and the second sync signal when it is detected that the phase relation is in the match state.

4. The apparatus according to claim 3, wherein:

the determining device is a first determining device; and the second detecting device comprises:

a match detection signal generating device which generates a match detection signal having a preset pulse width on the basis of the third sync signal; and a second determining device which determines that the phase relation is in the match state when the timing of one pulse of the first sync signal is included within a range of the pulse width of the generated match detection signal.

5. The apparatus according to claim 4, wherein the match detection signal generating device generates the match detection signal having the pulse width in which timing of one pulse of the third sync signal is set to the center timing.

6. The apparatus according to claim 1, wherein the direction denotes the vertical direction in the display device, the first sync signal is a vertical sync signal, the other direction denotes the horizontal direction, and the second sync signal is a horizontal sync signal.

7. A display position control apparatus which uses a first sync signal to control a display position of an image in one direction of a matrix type display device and a second sync signal, which is different from the first sync signal, to control the display position of the image in another direction of the display device to generate a position control signal to control the display position of the image in the display device, comprising:

a first sync signal generating device which generates a third sync signal having a phase difference held in a preset match state with respect to the phase of the first sync signal;

a first detecting device which detects whether a phase relation between the phase of the first sync signal and the phase of the second sync signal is held in a preset mismatch state; and a first control signal generating device which generates the position control signal on the basis of the first sync signal and the third sync signal when it is detected that the phase relation is in the mismatch state, and generates the position control signal on the basis of the first sync signal and the second sync signal when it is not detected that the phase relation is in the mismatch state, a second detecting device which detects whether the phase relation between the phase of the first sync signal and the phase of the second sync signal is in the match state; and a second control signal generating device which generates the position control signal on the basis of the first sync signal and the second sync signal when it is detected that the phase relation is in the match state, wherein the second detecting device comprises: a match detection signal generating device which generates a match detection signal having a preset pulse width on the basis of the third sync signal; and a determining device which determines that the phase relation is in the match state when the timing of one pulse of the first sync signal is included within a range of the pulse width of the generated match detection signal.

8. The apparatus according to claim 7, wherein the match detection signal generating device generates the match detection signal having the pulse width in which timing of one pulse of the third sync signal is set to the center timing.

* * * * *

UNITED STATES PATENT AND TRADEMARK OFFICE

CERTIFICATE OF CORRECTION

PATENT NO. : 6,879,321 B2
APPLICATION NO. : 10/179266
DATED : April 12, 2005
INVENTOR(S) : Osamu Santou It is certified that error appears in the above-identified patent and that said Letters Patent is hereby corrected as shown below:

On Title Page

Under Assignee: item 73

Please delete: ~~Pioneer Corporation, Tokyo To (JP); Shizuoka Pioneer Corporation, Shizuoka Ken (JP)~~; and insert: Pioneer Corporation, Tokyo- To (JP); Pioneer Display Products Corporation, Shizuoka-Ken, (JP)

Signed and Sealed this

Seventeenth Day of April, 2007

JON W. DUDAS
*Director of the United States Patent and Trademark Office*